US005461552A

United States Patent [19]

Tillery

[11] Patent Number: 5,461,552

[45] Date of Patent: Oct. 24, 1995

[54] ADJUSTABLE BEAM FLASHLIGHT

[76] Inventor: Ricky W. Tillery, 6438 Beryl St., Alta Loma, Calif. 91701

[21] Appl. No.: 206,060

[22] Filed: Mar. 4, 1994

[51] Int. Cl.[6] ..... F21L 7/00

[52] U.S. Cl. ..... 362/188; 362/203; 362/205; 362/158

[58] Field of Search ..... 362/158, 188, 362/203, 205

[56] References Cited

U.S. PATENT DOCUMENTS

| | | | |
|---|---|---|---|
| 4,504,890 | 3/1985 | Chan | 362/203 |
| 4,864,474 | 9/1989 | Maglica | 362/203 |
| 5,158,358 | 10/1992 | Maglica et al. | 362/203 |
| 5,345,370 | 9/1994 | Murray et al. | 362/205 |

*Primary Examiner*—Carroll B. Dority
*Attorney, Agent, or Firm*—Hawes & Fischer

[57] ABSTRACT

A miniature, adjustable beam flashlight having a switch control nut that is rotatable in first and opposite directions around the body of the flashlight for controlling a switch assembly in order to energize a lightbulb and adjust the light beam produced thereby. The switch assembly is interconnected with the switch control nut so as to move in first and opposite longitudinally extending directions through the body of the flashlight to complete or open an electrical conduction path between a battery supply and the lightbulb when the nut is rotated in the first or opposite directions around the body. The lightbulb is coupled to the switch assembly and adapted to move therewith in the first and opposite longitudinally extending directions so that the lightbulb is axially advanced relative to the body when the electrical circuit path is opened or retracted when the circuit path is completed. All of the foregoing is accomplished without having to manipulate the head of the flashlight as is otherwise required to operate some conventional adjustable beam flashlights.

19 Claims, 5 Drawing Sheets

ADJUSTABLE BEAM FLASHLIGHT

BACKGROUND OF THE INVENTION

1. Field of the Invention

This invention relates to a miniature, adjustable beam flashlight having a switch control nut that is rotatable around the body of the flashlight for closing a switch assembly in order to energize a lightbulb and adjust the light beam produced thereby. The foregoing is accomplished without having to manipulate the head of the flashlight as is otherwise required to operate some conventional adjustable beam flashlights.

2. Background Art

Miniaturized, adjustable beam flashlights are commercially available for providing a user with a compact, lightweight source of light. In the case of one popular adjustable beam flashlight, the user is required to rotate or otherwise manipulate the head of the flashlight in order to close a switch and thereby energize a lightbulb. That is to say, the head of the flashlight is moved axially so as to either supply power to or remove power from the bulb. However, a relatively large amount of strength and/or the use of both hands may be required for the user to operate such a flashlight. Some users, particularly the elderly, disabled or young children, find this requirement to be inconvenient which, in some cases, may render the flashlight useless.

Examples of patents relating to a miniature flashlight where the head of the flashlight is displaced (i.e. rotated and/or axially advanced) relative to the body so as to energize the lightbulb are available by referring to one or more of the following U.S. Pat. Nos.:

4,823,242 Apr. 18, 1989

4,864,474 Sep. 5, 1989

5,121,308 Jun. 9, 1992

5,143,441 Sep. 1, 1992

Examples of patents relating to a miniature flashlight where the lightbulb is moved axially relative to the head to adjust the light beam are available by referring to one or more of the following U.S. Pat. Nos.:

4,388,673 Jun. 14, 1983

4,527,223 Jul. 2, 1985

4,956,755 Sep. 11, 1990

SUMMARY OF THE INVENTION

A miniature, adjustable beam flashlight is disclosed having a tubular body or barrel, a head at the front of the body, and a removable end cap at the rear of the body to facilitate the removal or replacement of batteries. A switch control nut is rotatable around the body to open or close a switch assembly and thereby control the energization of the lightbulb of the flashlight. What is more, a rotation of the switch control nut around the body also causes an axial displacement of the lightbulb relative to the head so as to adjust the diameter and magnitude of the light beam. The foregoing is accomplished without requiring the user to manipulate the head of the flashlight, such that the head remains stationary as the switch control nut is rotated and the lightbulb is axially displaced.

The rotatable switch control nut is coupled by means of a pair of drive pins to the switch assembly at a contact insulator which is located within and movable reciprocally through the body of the flashlight. The drive pins extend between the nut and the insulator by way of upwardly and forwardly sloping slots formed through the body. A rotation of the switch control nut causes a corresponding axial movement of the contact insulator through the body. The contact insulator carries a pair of contacts which are adapted to complete an electrical conduction path between the batteries and the lightbulb. When the switch control nut is rotated in a first direction, the switch assembly is disposed in the off position, such that the contact insulator and the contacts thereof are spaced from the batteries to open the electrical conduction path between the batteries and the lightbulb, whereby the lightbulb is deenergized. When the switch control nut is rotated in the opposite direction, the switch assembly is disposed in the on position, such that the contact insulator engages the batteries to complete the electrical conduction path (via the contacts carried by the insulator) between the batteries and the lightbulb, whereby the lightbulb is now energized.

The contact insulator of the switch assembly is interconnected with a lamp holder that surrounds and supports the lightbulb within the head of the flashlight. Therefore, an axial movement of the contact insulator through the body of the flashlight will impart a corresponding axial movement to the lamp holder. Accordingly, when the switch control nut is rotated in the first direction so that the switch assembly is in the off position and the contact insulator is spaced from the batteries, the lamp holder and the light bulb supported thereby are both advanced axially and away from the reflector at the head of the flashlight. However, when the switch control nut is rotated in the opposite direction so that the switch assembly is in the on position and the contact insulator is moved into contact with the batteries, the lamp holder and the lightbulb are retracted towards the reflector of the head. In this manner, the diameter and intensity of the light beam being generated by the lightbulb may be adjusted depending upon the direction in which the switch control nut is rotated and the corresponding position of the lightbulb relative to the reflector.

DETAILED DESCRIPTION

Figure 1:
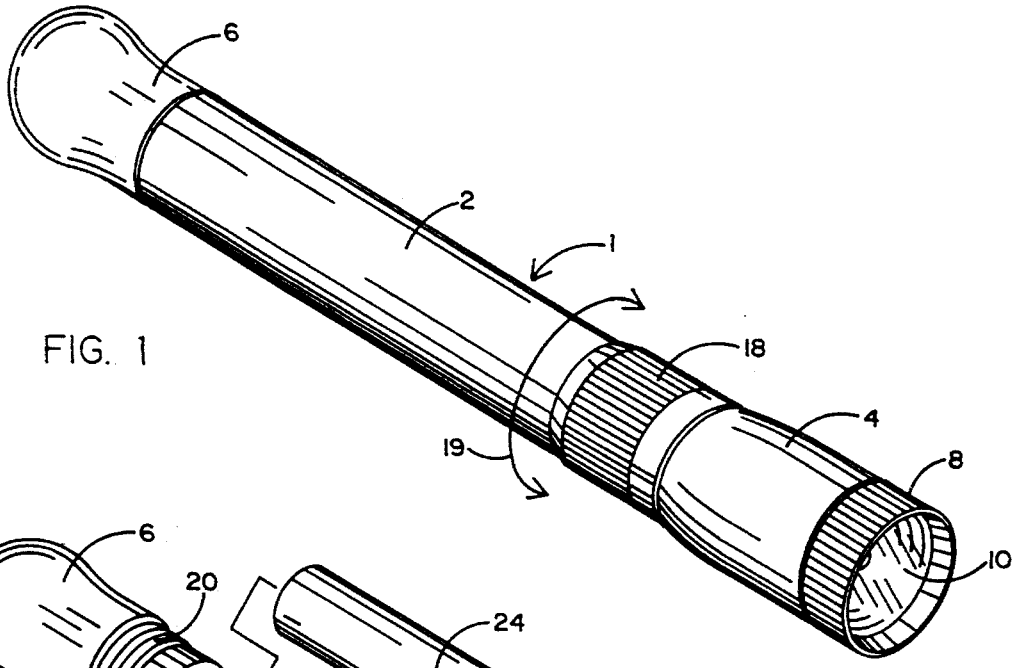
FIG. 1 is a perspective view of the miniature, adjustable beam flashlight which forms the present invention.
Figure 2:
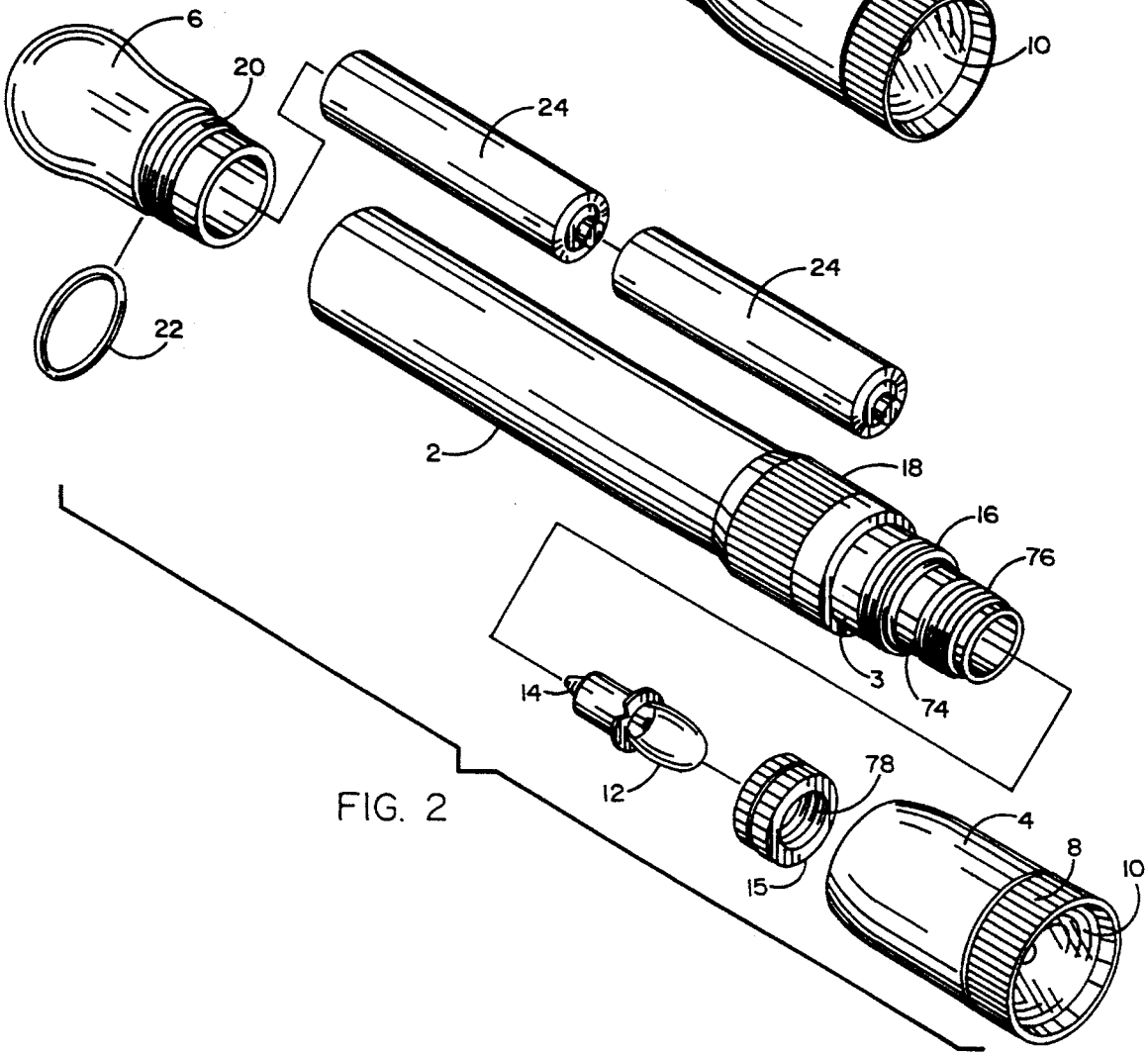
FIG. 2 is an exploded view of the adjustable beam flashlight of FIG. 1.

The adjustable beam flashlight 1 which forms the present invention is now described while referring to FIGS. 1 and 2 of the drawings. The flashlight 1 has a generally tubular body or barrel 2, a head 4 located at the forward end 3 of the body 2, and an end cap 6 located at the rear of the body 2. The overall length of the flashlight 1 is usually between seven to nine inches such that it is sometimes referred to as being miniature in size. The body 2, head 4 and end cap 6 of flashlight 1 are preferably manufactured from a conductive material (e.g. aluminum) that has been anodized, although the particular conductive material is not intended to form a limitation of this invention. A lens cap 8 is removably attached (e.g. screwed on) to the head 4 of flashlight 1. The lens cap 8 supports a transparent lens 10 which covers a conventional lightbulb 12 having the usual terminal 14 in electrical contact with the filament. The light bulb 12 is surrounded within the head 4 by a lamp nut 15 (best shown in FIG. 2) having a set of screw threads 78 extending around the interior thereof.

As is also best shown in FIG. 2, the forward end 3 of the flashlight body 2 has a set of screw threads 16 extending therearound to enable the body 2 to be detachably connected to the head 4 of flashlight 1 at a corresponding set of screw threads (not shown). The forward end 3 of body 2 is sized to receive therewithin a lamp holder 74 (best described while referring to FIGS. 4 and 5). Lamp holder 74 has a set of screw threads 76 extending therearound to be mated to the screw threads 78 of lamp nut 15, whereby the lamp holder 74 is attached to the lightbulb 12.

A knurled switch control nut 18 is disposed around the forward end 3 of the body 2 of flashlight 1 and adapted to be rotated (in either of the directions indicated by the reference arrows 19 of FIG. 1). As will be described in greater detail and as an important aspect of the present invention, a rotation of the switch control nut 18 relative to the stationary body 2 of flashlight 1 causes a corresponding axial displacement of the lightbulb 12 relative to the head 4 and an energization of the bulb.

Figure 6:
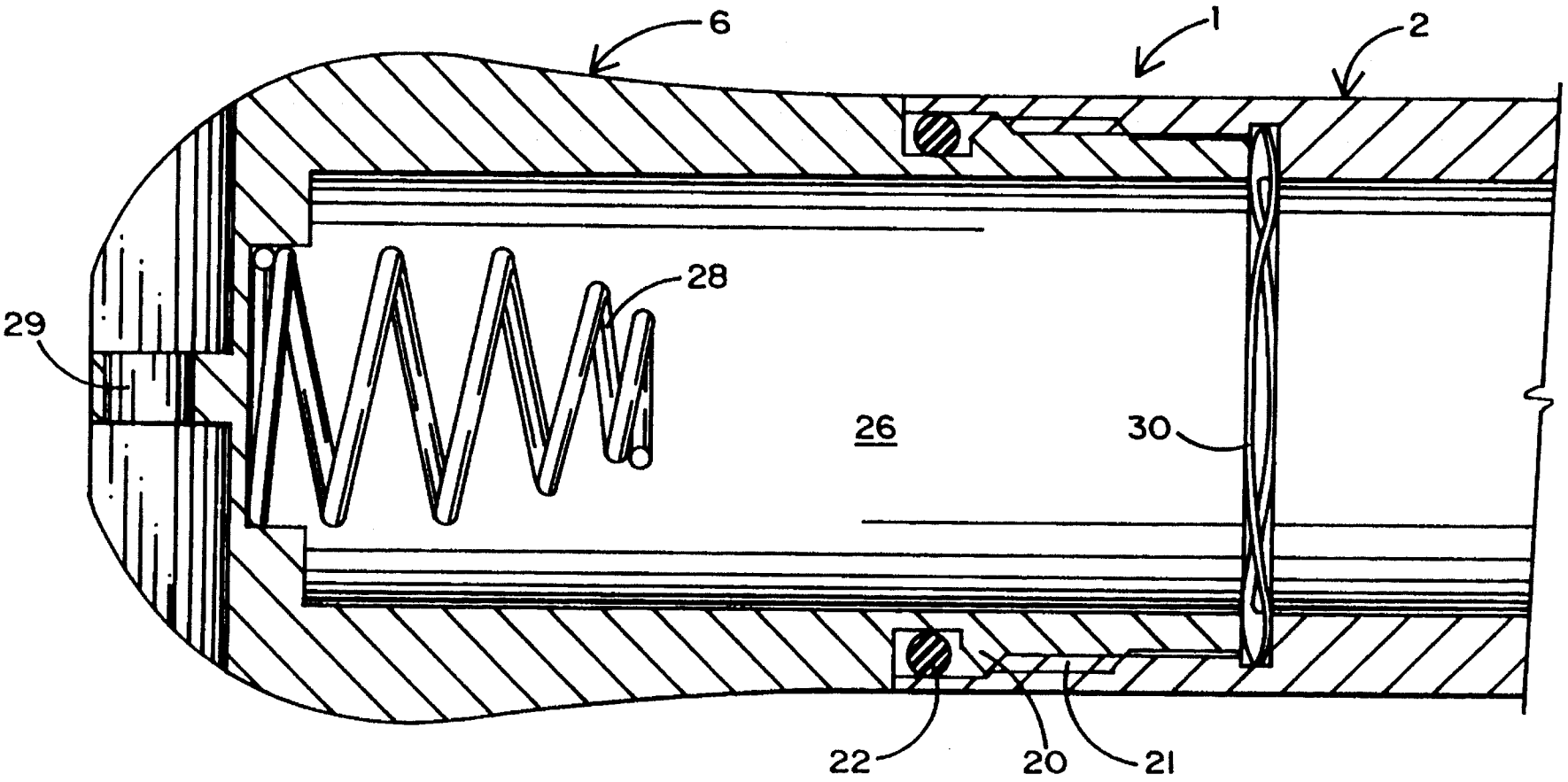
FIG. 6 is a cross section of an end cap of the flashlight in which the batteries are removably received for powering the lightbulb.

The end cap 6 of flashlight 1 has a set of screw threads 20 extending therearound by which the end cap is removably attached to the rear of the body 2 at a corresponding set of screw threads (designated 21 and best shown in FIG. 6). A rubber washer 22 is received at the intersection of end cap 6 with body 2 to prevent the invasion of moisture into the hollow battery compartment (designated 26 and also best shown in FIG. 6). That is, the end cap 6 may be removed from the rear of body 2 to permit access to the battery compartment 26. In this manner, a pair of conventional 1.5 volt batteries 24 may be removed from or inserted into the battery compartment to power the lightbulb 12.

Figure 3:
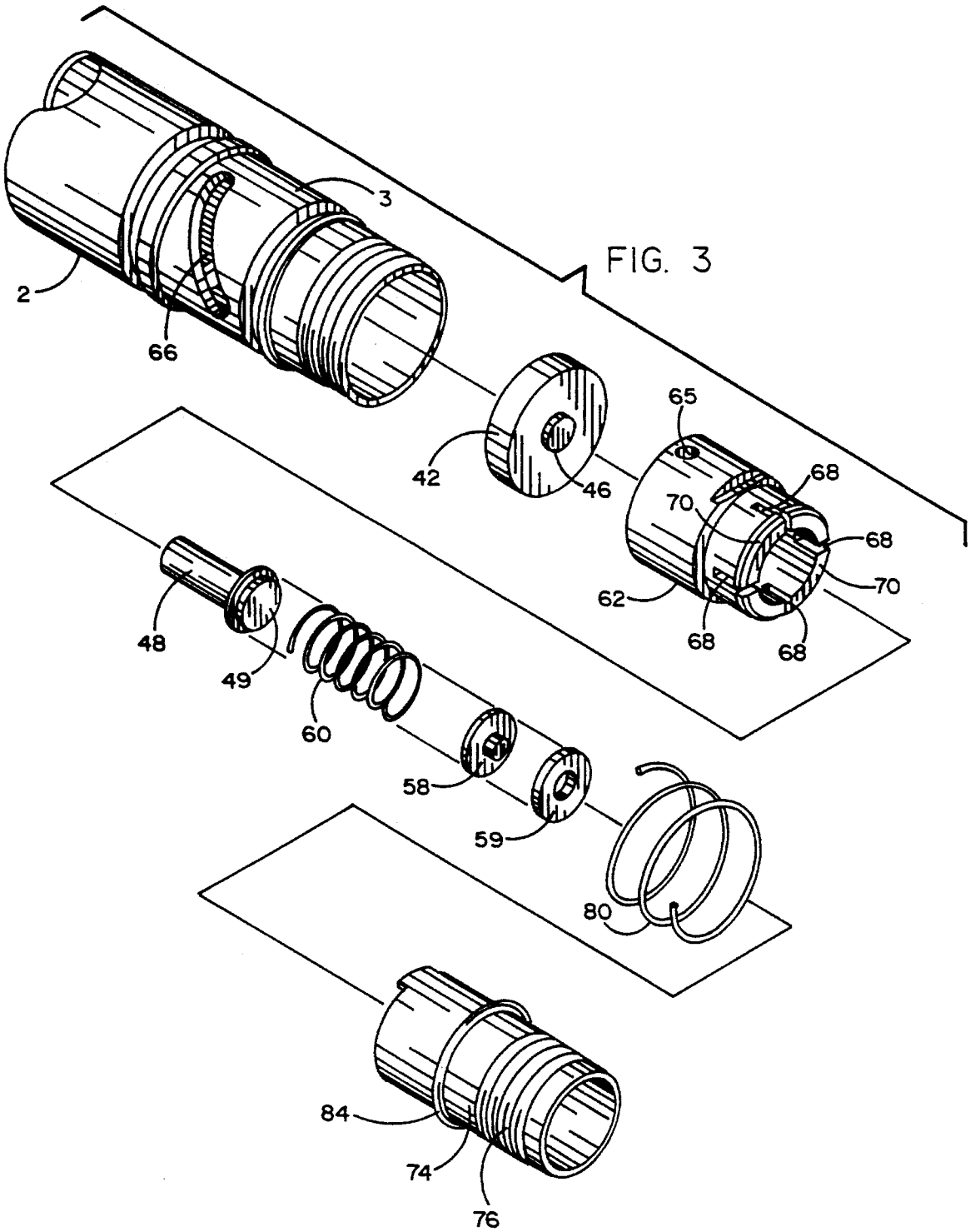
FIG. 3 is an exploded view of a switch assembly removed from the front of the body of the flashlight of FIG. 1.
Figure 4:
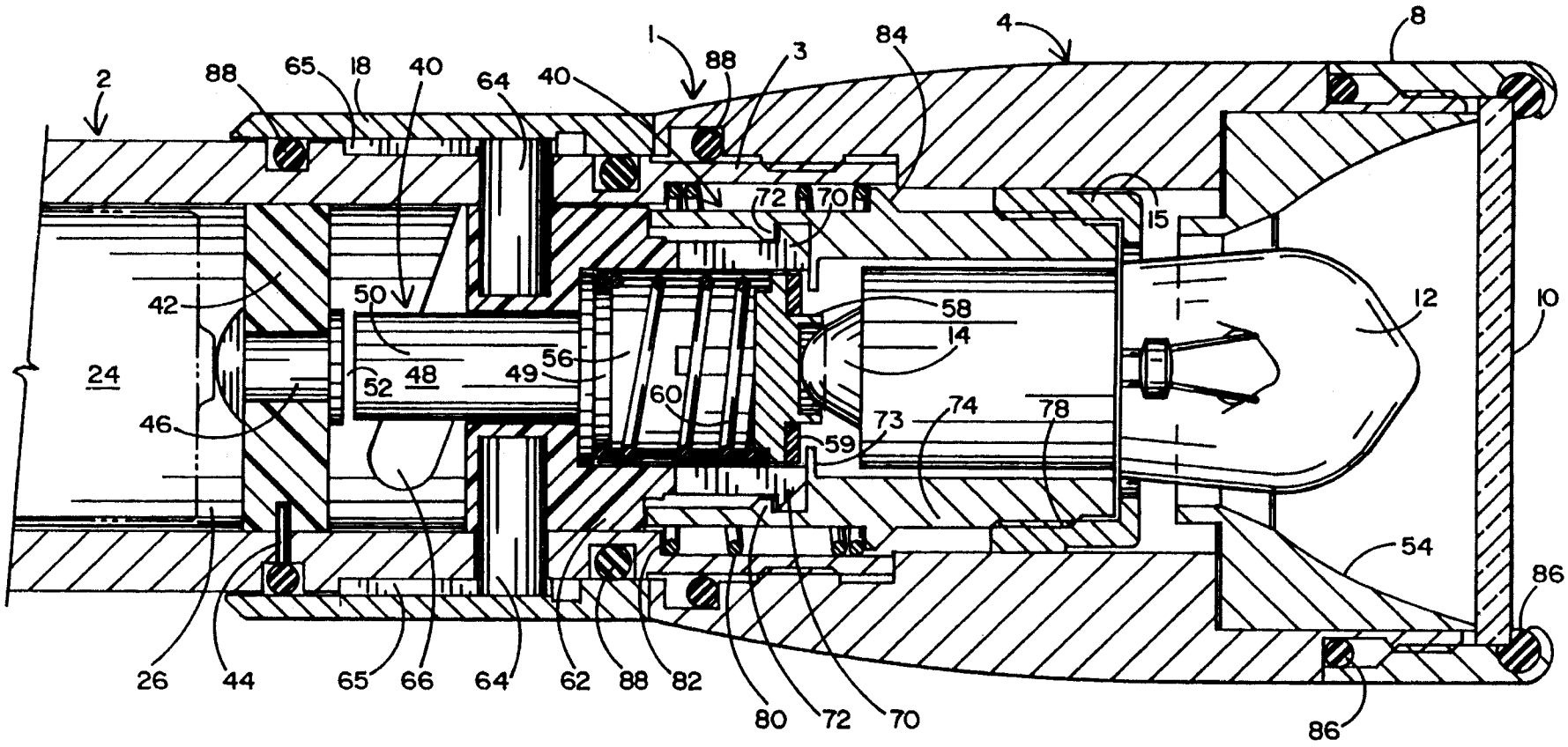
FIG. 4 is a cross section of the flashlight showing the switch assembly of FIG. 3 in the off position such that the lightbulb is deenergized.

Referring concurrently to FIGS. 3 and 4 of the drawings, the switch assembly 40 of flashlight 1 for energizing or deenergizing the lightbulb 12 is described in the off position such that the batteries 24 are disconnected from the lightbulb 12, whereby bulb 12 is deenergized. Extending laterally across the body 2 of flashlight 1 is a non-conductive battery stop 42. The battery stop 42 and the end cap 6 (of FIG. 6) define opposite ends of the hollow battery compartment 26 in which the batteries 24 are received. The battery stop 42 is affixed to the body 2 by means of a press fit dowel pin 44 which presents a displacement of stop 42. An electrically conductive battery contact rivet 46 extends longitudinally through the battery stop 42 so as to complete an electrical conduction path between the batteries 24 and the terminal 14 of lightbulb 12 when the switch assembly 40 is in the on position (best shown in FIG. 5).

Switch assembly 40 includes a rear contact 48 which is axially aligned with the battery contact rivet 46. The rear contact 48, which has a wide head 49 and a relatively narrow body 50 extending therefrom, is slidable axially towards and away from the lightbulb 12 through a contact chamber 56. With switch assembly 40 in the off position shown in FIG. 4, the body 50 of rear contact 48 will be spaced from the battery contact rivet 46 such that a gap 52 (e.g. of approximately 0.025 inches) is established therebetween, whereby to open the electrical conduction path between the batteries 24 and the lightbulb 12. Therefore, the lightbulb 12 will be deenergized. Moreover, with the switch assembly 40 in the off position, the lightbulb 12 is located at an axially advanced position relative to a parabolic reflector 54 that is disposed within the head 4 of flashlight 1 below the lens 10.

Retained within the contact chamber 56, between the head 4 of rear contact 48 at one end of the chamber 56 and a front contact 58 at the opposite end of chamber 56 is an inner contact spring 60 that is manufactured from an electrically conductive material. In the present embodiment, the contact spring 60 is a coiled compression spring that is relaxed (i.e. expanded) when the switch assembly 40 is in the off position. As will soon be described when referring to FIG. 5, the inner contact spring 60 will be compressed in the on position of switch assembly 40 as the head 49 of rear contact 48 slides forwardly through the contact chamber 56 towards the front contact 58. An insulating ring 59 surrounds the front contact 58 to prevent the formation of a conduction path between contact 58 and a soon-to-be described electrically conductive lamp holder 74.

Switch assembly 40 also includes a non-conductive (e.g. plastic) contact insulator 62 which has the aforementioned contact chamber 56 formed through a forward end thereof and an opening in the rear end through which to receive and guide the body 50 of rear contact 48 as the head 49 of rear contact 48 moves through the contact chamber 56. Projecting radially outward (and in opposite directions) from the contact insulator 62 is a pair of drive pins 64. The drive pins 64, the function of which will be explained shortly, extend outwardly from holes (designated 65 in FIG. 3) formed in the contact insulator 62 for receipt through respective slots 66. The slots 66 through which drive pins 64 extend are formed at opposite sides of the forward end 3 of the body 2 of flashlight 1 so that, in the assembled configuration, the slots 66 are located adjacent and below the switch control nut 18 surrounding body 2. Each slot 66 (only one of which being visible) slopes upwardly and forwardly from the rear to the front of the body 2 to permit the drive pins 64 to ride reciprocally therethrough.

That is, the drive pins 64 extend radially outward from the contact insulator 62, through the opposing slots 66 in body 2, to be captured at longitudinally extending grooves 65 formed in the underside of the switch control nut 18. Thus, as will be described in greater detail hereinafter, a rotation of the nut 18 around the body 2 causes the drive pins 64 to ride through the slots 66 for imparting a corresponding axial displacement to the contact insulator 62 through the forward end 3 of the body 2 of flashlight 1.

The contact insulator 62 has a plurality of evenly spaced, longitudinally extending slits (designated 68 and best shown in FIG. 3) formed through the front thereof so as to define a corresponding plurality of axially projecting fingers 70 therebetween. The fingers 70 of contact insulator 62 have flanged tips that project radially outward to engage a radially inward projecting peripheral lip 72 which extends around the rear of a cylindrical lamp holder 74. The tips of fingers 70 but up against a radially inward projecting ring 73 of lamp holder 74, which ring is spaced forwardly from the lip 72 of lamp holder 74. The front of the lamp holder 74 surrounds and supports the base of the lightbulb 12 so that the terminal 14 of bulb 12 is maintained in electrical contact with the front contact 58 of the switch assembly 40.

As is best shown in FIG. 3, the front of the lamp holder 74 has a series of screw threads 76 formed around the outside thereof so as to be mated to a corresponding set of screw threads (designated 78 in FIG. 4) extending around the inside of the lamp nut 15 (also shown in FIG. 2). The lamp nut 15 and the lamp holder 74 cooperate with one another to retain the lightbulb in engagement with the contact insulator 62 (by means of the receipt of the fingers 70 of contact insulator 62 between the lip 72 and ring 73 of lamp holder 74) so that an axial displacement of the contact insulator 62 (caused by the aforementioned rotation of the switch control nut 18) is translated into a corresponding axial movement of the bulb 12 through the head 4 of flashlight 1.

Arranged in coaxial alignment with the inner contact spring 60 and located in a channel between the forward end 3 of the body 2 of flashlight 1 and the lamp holder 74 is an outer contact spring 80. Spring 80 is manufactured from an electrically conductive material and helps to complete an electrical return path between the lightbulb 12 and the batteries 24. Like inner contact spring 60, the outer contact spring 80 is a coiled compression spring that is relaxed (i.e. expanded) when the switch assembly 40 is in the off position. Moreover, and as will be disclosed when referring to FIG. 5, the outer contact spring 80 will be compressed in the on position of switch assembly 40 between an inner ledge 82 at the forward end 3 of the body 2 and an outwardly projecting peripheral lip 84 of lamp holder 74. The outward projecting lip 84 and the inward projecting lip 72 extend in opposite directions relative to one another from the lamp holder 74.

The adjustable beam flashlight 1 illustrated in FIG. 4 is completed by arranging a first set of O-ring seals 86 around the end cap 8 at the head 4 and a second set of O-ring seals 88 around the switch assembly 40 within the body 2. Seals 86 and 88 prevent the invasion of water into the flashlight 1 at the various intersections of the body 2, the head 4, the lens cap 8 and the switch control nut 18.

In operation, to move the switch assembly 40 of flashlight 1 to the off position shown in FIG. 4, the switch control nut 18 is first rotated in a clockwise direction around the forward end 3 of the body 2. A clockwise rotation of nut 18 causes the drive pins 64 to ride forwardly (in a direction towards the head 4) through their respective drive slots 66, whereby to cause a corresponding axial (i.e. forward) displacement of the contact insulator 62 to which drive pins 64 are connected. The axial, forward displacement of contact insulator 62 is transferred to the lamp holder 74 by means of the fingers 70 of contact insulator 62 pushing on the inwardly projecting ring 73 of lamp holder 74. Accordingly, the lamp holder 74, and the lamp nut 15 mated thereto, are advanced together axially and forwardly towards the end cap 8, whereby the lightbulb 12 will also be moved forwardly towards the lens 10 and away from the reflector 54.

The forward displacement of contact insulator 62 through the body 2 of flashlight 1 also pulls the rear contact 48 (at the relatively wide head 49 thereof) in the same forward direction so as to move the contact body 50 away from the battery contact rivet 48 and thereby establish the gap 52 therebetween. Hence, the electrical conduction path between the batteries 24 and the terminal 14 of the lightbulb 12 is opened, whereby the bulb will be both deenergized and located at its forward-most position relative to the head 4.

Moreover, in the forward-most position of the lamp holder 74 through body 2, the head 49 of rear contact 48 and the front contact 58 are spaced from one another at opposite ends of the contact chamber 56 of the contact insulator 62 so that the inner contact spring 60 which extends between contacts 48 and 58 is relaxed (i.e. expanded). Similarly, the outwardly projecting lip 84 of lamp holder 74 is spaced forwardly from the inner ledge 82 at the forward end 3 of body 2 so that the outer contact spring 80 which extends between ledge 82 and lip 84 is also relaxed, whereby the switch assembly is maintained in the off position and the bulb 12 remains deenergized.

Figure 5:
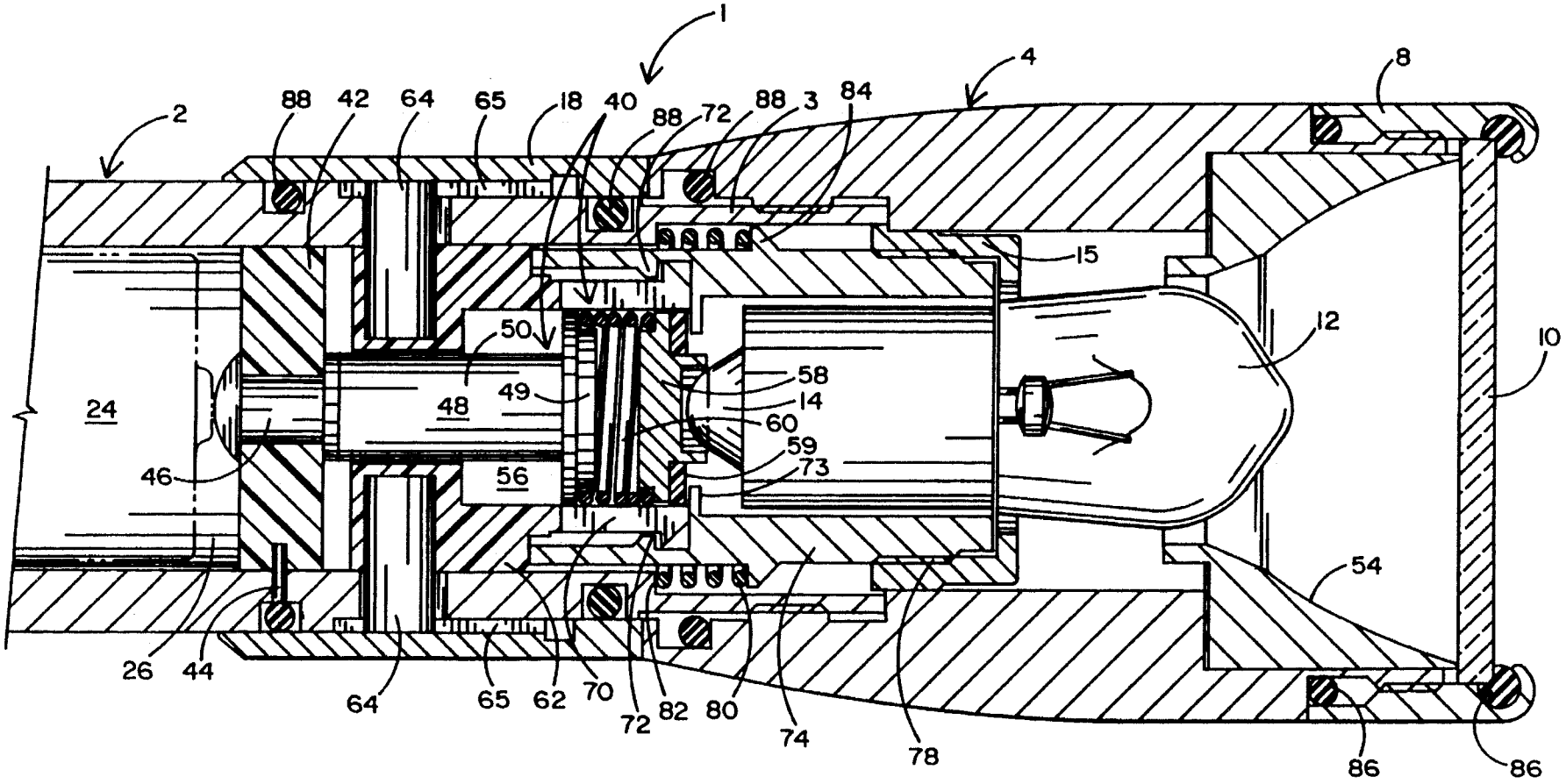
FIG. 5 is a cross section of the flashlight showing the switch assembly of FIG. 3 in the on position such that the flashlight is energized.

Referring now to FIG. 5 of the drawings, the switch assembly 40 of the miniature, adjustable beam flashlight 1 is shown in the on position so that the lightbulb can be energized to provide a focused beam of light. More particularly, to move the switch assembly 40 of flashlight 1 to the on position shown in FIG. 5, the switch control nut 18 is first rotated in a counter-clockwise direction around the forward end 3 of the body 2 of flashlight 1. A counter-clockwise rotation of the nut 18 causes the drive pins 64 to ride rearwardly (i.e. in a direction away from the head 4) through their respective drive slots 66, whereby to cause a corresponding axial (i.e. rearward) displacement of the contact insulator 62. The axial, rearward displacement of the contact insulator 62 is transferred to the lamp holder 74 by means of the fingers 70 of contact insulator 62 pulling on the inwardly projecting lip 72 of lamp holder 74. Accordingly, the lamp holder 74 and the lamp nut 15 mated thereto are also moved axially and rearwardly through the body 2 of flashlight 1, whereby the lightbulb 12 will be retracted rearwardly towards the reflector 54.

The rearward displacement of the contact insulator 62, the lamp holder 74 and the lightbulb 12 also causes the rear contact 48 to move in the same rearward direction. More particularly, the contact body 50 is moved towards and into engagement with the battery contact rivet 48, whereby the former gap 52 therebetween is now eliminated. Hence, an electrical conduction path is established between the batteries 24 and the terminal 14 of lightbulb 12 (via battery contact rivet 46, rear contact 48, inner contact spring 60 and front contact 58), whereby the lightbulb 12 will be both energized to provide a source of illumination and retracted to its rearward-most position relative to the head 4.

Moreover, in the rearward-most position of the lamp holder 74 through body 2, lamp holder 74 will be positioned adjacent the battery stop 42. Because battery stop 42 is fixed (by means of dowel pin 44) and not subject to a similar rearward displacement, the body 50 of rear contact 48 will be moved into engagement with the battery contact rivet 46 that is retained by battery stop 42. The foregoing results in the head 49 of rear contact 48 moving through the contact chamber 56, against the bias of inner contact spring 60 and towards the front contact 58. Accordingly, the head 49 of rear contact 48 and the front contact 58 are moved relatively close together within the contact chamber 56 so that the inner contact spring 60 which extends between the rear and front contacts 48 and 58 is now compressed. Similarly, the outwardly projecting lip 84 of the lamp holder 74 is moved towards the inner ledge 82 of body 2 so that the outer contact spring 80 which extends between ledge 82 and lip 84 is also compressed, whereby the switch assembly 40 is maintained in the on position with the lightbulb 12 being energized to emit an adjustable beam of light through lens 10.

FIG. 6 of the drawings shows details of the end cap 6 of adjustable beam flashlight 1 and the hollow battery compartment 26 thereof in which the batteries (designated 24 in FIGS. 1, 4 and 5) are located for providing power to the lightbulb 12. Projecting axially from the rear of end cap 6 into the battery compartment 26 is an electrically conductive end spring 28. The end spring 28 is a helically wound, normally relaxed (i.e. expanded) spring that is compressed when the battery compartment 26 is filled with batteries. When batteries extend longitudinally through the battery compartment 26, the end spring 28 at the rear of compartment 26 urges the batteries forward into electrical contact with the battery contact rivet (designated 46 in FIGS. 4 and 5) at the front of compartment 26. Moreover, the end spring 28 completes an electrical return path from the lightbulb 12 to the batteries via the outer contact spring 80 and the aluminum body 2 and end cap 6 of flashlight 1.

As previously described when referring to FIG. 2, a series of screw threads 20 extends around the front of the end cap 6 to be mated to a corresponding series of screw threads 21 that extends around the rear of the body 2 of flashlight 1, whereby the end cap 6 and body 2 are removably connected together. A relatively narrow tail 29 is formed at the rearmost end of end cap 6 to be gripped by a suitable tool (not shown) to facilitate the rotation and removal of the end cap 6 from the body 2 to install or remove batteries. Positioned around the intersection of the end cap 6 and body 2 is an electrically conductive (e.g. copper or nickel plated steel) wave spring washer 30. Wave spring washer 30 has a suitable diameter to permit the batteries to extend longitudinally through the battery compartment 26 without interference. However, the wave spring washer 30 maximizes the conductivity of the electrical return path between the body 2 and the end cap 6 of flashlight 1 while minimizing the machining that would otherwise be required after the aluminum end cap and body are anodized.

Accordingly, it may now be appreciated that the switch assembly 40 of FIGS. 4 and 5 is moved to either of the off or on positions for controlling the energization of the lightbulb 12 by rotating the switch control nut 18 in a clockwise or counter clockwise direction around the body 2 of flashlight 1. However, the head 4 of the flashlight 1 remains stationary regardless of the position to which the switch assembly 40 is moved. Moreover, a rotation of the switch control nut 18 is also translated into a corresponding axial displacement of the lightbulb 12 rearwardly towards the reflector 54 of head 4 when the switch assembly 40 moves to the on position or forwardly away from the reflector 54 when the switch assembly 40 moves to the off position. In this manner, the diameter and intensity of the light beam generated by the lightbulb 14 can be adjusted depending upon the direction in which the switch control nut 18 is rotated and the corresponding position of the bulb 14 relative to the reflector 54. What is more, the miniature flashlight 1 can be held and the switch control nut 18 rotated with a single hand without requiring much strength or manual dexterity.

It will be apparent that while a preferred embodiment of the invention has been shown and described, various modifications and changes may be made without departing from the true spirit and scope of the invention. For example, although the flashlight 1 herein described has been referred to as being miniature in size, it is to be understood that this invention is also applicable to flashlights of any size.

Having thus set forth the preferred embodiment of the invention, what is claimed is:

1. A flashlight having a generally hollow body and comprising:

a lightbulb to emit a light beam;

a head fixedly attached at one end of said body to surround said lightbulb and reflect the light beam emitted thereby;

a source of power to energize said lightbulb;

switch means located in said body and movable between closed and open switch positions to complete or break an electrical circuit path between said source of power and said lightbulb; and switch actuation means and means coupling said switch actuation means to said switch means, said switch actuation means being rotatable around said body relative to said head that is fixedly attached to said body, said switch actuation means being rotated in a first direction around said body to move said switch means to the closed switch position and thereby complete the electrical circuit path between said power source and said lightbulb or said switch actuation means being rotated in an opposite direction around said body to move said switch means to the open switch position and thereby break the electrical circuit path between said power source and said lightbulb.

2. The flashlight recited in claim 1, further comprising means located within said body to interconnect said switch means to said lightbulb, such that said lightbulb moves to a longitudinally advanced position relative to said body when said switch means is moved to the open switch position, or said lightbulb moves oppositely to a retracted position relative to said body when said switch means is moved to the closed switch position.

3. The flashlight recited in claim 1, wherein said means coupling said switch actuation means comprises at least one drive slot formed through said body and a drive pin extending through and ridable along said slot, said drive pin extending between said switch actuation means and said switch means such that a rotation of said switch actuation means in said first and opposite directions around said body causes said switch means to be displaced in corresponding first and opposite longitudinally extending directions through said body.

4. The flashlight recited in claim 3, wherein said switch actuation means is a nut surrounding said body and the drive slot formed through said body, said nut being rotatable around said body relative to said drive slot to cause said drive pin to ride along said slot and said switch means to be displaced longitudinally through said body.

5. The flashlight recited in claim 3, wherein said switch means includes an insulator located within and movable in said first and opposite longitudinally extending directions through said body when said switch actuation means is rotated in said first and opposite directions around said body, said insulator carrying a first electrical contact that is moved into engagement with said source of power to complete the electrical circuit path to said lightbulb when said insulator moves longitudinally in said first direction through said body, or said electrical contact moved out of engagement with said source of power to open said electrical circuit path when said insulator moves longitudinally in said opposite direction through said body.

6. The flashlight recited in claim 5, including a lamp holder interconnected with said insulator and movable with said insulator in said first and opposite longitudinally extending directions through said body, said lamp holder interconnected with said lightbulb so that a movement of said insulator in said first and opposite longitudinally extending directions is transferred to said lightbulb by way of said lamp holder.

7. The flashlight recited in claim 6, further comprising compression spring means arranged coaxially with respect to said lightbulb and extending between said lamp holder and said body in an electrical return path between said lightbulb and said source of power, said spring means being compressed when said lamp holder moves with said insulator in said first longitudinally extending direction through said body.

8. The flashlight recited in claim 5, wherein said insulator has a hollow contact chamber formed at the interior thereof, said first electrical contact located at one end of said contact chamber to be moved into or out of engagement with said source of power to complete or open said electrical circuit path, a second electrical contact located at the opposite end of said contact chamber and electrically connected in said circuit path to said lightbulb, and electrically conductive resilient means connected in said circuit path and extending between said first and second contacts.

9. The flashlight recited in claim 8, wherein said resilient means extending between said first and second contacts in said contact chamber of said insulator is a compression spring.

10. The flashlight recited in claim 9, wherein said first contact is slidable through said contact chamber of said insulator towards said second contact when said insulator moves in said first longitudinally extending direction through said body and said first contact is moved into engagement with said source of power to complete the electrical circuit path to said lightbulb, such that said compression spring is compressed between said first and second contacts.

11. A flashlight including a generally hollow body having a longitudinal axis and a head fixedly attached to said body, said flashlight comprising:

a light bulb located within the head to emit a light beam;

a source of power to energize said lightbulb;

switch means located within said body and movable along the longitudinal axis thereof between closed and open switch positions to complete or break an electrical circuit path between said source of power and said lightbulb;

means for coupling said switch means to said lightbulb; and switch actuation means and means coupling said switch actuation means to said switch means, said switch actuation means being rotatable around said body relative to said head, such that said head is stationary when said switch actuation means rotates, said switch actuation means being rotated to a first location around said body to move said switch means along said longitudinal axis and in a first direction through said body to the closed switch position to thereby complete the electrical circuit path between said power source and said lightbulb with said lightbulb coupled to said switch means also moving in said first direction along said longitudinal axis, said switch actuation means being rotated to a second location around said body to move said switch means along said longitudinal axis and in an opposite direction through said body to the open switch position to thereby break the electrical circuit path between said power source and said lightbulb with said lightbulb also moving in said opposite direction along said longitudinal axis.

12. The flashlight recited in claim 11, wherein said means coupling said switch actuation means includes at least one drive slot formed through said body and a drive pin extending through and ridable along said slot, said drive pin extending between said switch actuation means and said switch means such that a rotation of said switch actuation means to said first and second locations around said body causes said switch means to be displaced in said first and opposite directions through said body.

13. The flashlight recited in claim 12, wherein said switch actuation means is a nut surrounding said body and the drive slot formed through said body, said nut being rotatable around said body relative to said drive slot to cause said drive pin to ride along said slot and said switch means to be displaced through said body.

14. The flashlight recited in claim 12, wherein said switch means includes an insulator located within and movable in said first and opposite directions through said body when said switch actuation means is rotated to said first and opposite locations around said body, said insulator carrying a first electrical contact that is moved into engagement with said source of power to complete the electrical circuit path to said lightbulb when said insulator moves in said first direction through said body, or said electrical contact moved out of engagement with said source of power to open said electrical circuit path when said insulator moves in said opposite direction through said body.

15. The flashlight recited in claim 14, further comprising a lamp holder interconnected with said insulator and movable with said insulator in said first and opposite directions through said body, said lamp holder interconnected with said lightbulb so that a movement of said insulator in said first and opposite directions is transferred to said lightbulb by way of said lamp holder.

16. The flashlight recited in claim 15, including compression spring means arranged coaxially with respect to said lightbulb and extending between said lamp holder and said body in an electrical return path between said lightbulb and said source of power, said spring means being compressed when said lamp holder moves with said insulator in said first direction through said body.

17. The flashlight recited in claim 14, wherein said insulator has a hollow contact chamber formed at the interior thereof, said first electrical contact located at one end of said contact chamber to be moved into or out of engagement with said source of power to complete or open said electrical circuit path, a second electrical contact located at the opposite end of said contact chamber and electrically connected in said circuit path to said lightbulb, and electrically conductive resilient means connected in said circuit path and extending between said first and second contacts.

18. The flashlight recited in claim 17, wherein said resilient means extending between said first and second contacts in said contact chamber of said insulator is a compression spring.

19. The flashlight recited in claim 18, wherein said first contact is slidable through said contact chamber of said insulator towards said second contact when said insulator moves in said first direction through said body and said first contact is moved into engagement with said source of power to complete the electrical circuit path to said lightbulb, such that said compression spring is compressed between said first and second contacts.

* * * * *